US011661712B2

(12) United States Patent
Simovich

(10) Patent No.: US 11,661,712 B2
(45) Date of Patent: May 30, 2023

(54) SMART MODULAR STREET AND SIDEWALK

(71) Applicant: Guillermo David Simovich, Aventura, FL (US)

(72) Inventor: Guillermo David Simovich, Aventura, FL (US)

( * ) Notice: Subject to any disclaimer, the term of this patent is extended or adjusted under 35 U.S.C. 154(b) by 0 days.

(21) Appl. No.: 16/744,096

(22) Filed: Jan. 15, 2020

(65) Prior Publication Data

US 2020/0224371 A1 Jul. 16, 2020
US 2020/0224371 A1 Jul. 16, 2020

Related U.S. Application Data

(60) Provisional application No. 62/920,939, filed on May 23, 2019, provisional application No. 62/918,043, filed on Jan. 15, 2019.

(51) Int. Cl.

| | |
|---|---|
| ***E01C 5/00*** | (2006.01) |
| ***E01C 11/02*** | (2006.01) |
| ***E01C 11/26*** | (2006.01) |
| ***E01C 9/00*** | (2006.01) |
| *E01C 5/20* | (2006.01) |
| *E01C 5/06* | (2006.01) |

(52) U.S. Cl.
CPC ..... *E01C 5/00* (2013.01); *E01C 9/00* (2013.01); *E01C 11/02* (2013.01); *E01C 11/265* (2013.01); *E01C 5/06* (2013.01); *E01C 5/20* (2013.01); *E01C 2201/205* (2013.01)

(58) Field of Classification Search
CPC ..... E01C 5/00; E01C 5/06; E01C 5/20; E01C 9/00; E01C 11/02; E01C 11/265; E01C 2201/205
USPC ..... 14/2, 24, 26; 404/1
See application file for complete search history.

(56) References Cited

U.S. PATENT DOCUMENTS 3,688,327 A * 9/1972 Marshall ..... E01D 1/00 14/74.5
3,859,682 A * 1/1975 Sulkiewicz ..... E01D 2/00 14/3
5,101,755 A * 4/1992 Barrett ..... E01F 9/541 116/209
5,177,913 A * 1/1993 Erel ..... E04H 6/10 52/175
5,671,681 A * 9/1997 Senior, III ..... B61B 13/10 104/124
5,846,020 A * 12/1998 McKeown ..... E01C 1/002 404/1
5,978,998 A * 11/1999 Shivaram ..... E01C 3/00 14/75
6,668,729 B1 * 12/2003 Richards ..... B61B 15/00 104/124
6,682,259 B1 * 1/2004 Thomas, Sr. ..... E01D 4/00 14/24

(Continued)

*Primary Examiner* — Raymond W Addie
(74) *Attorney, Agent, or Firm* — David W. Barman; Shlomo S. Moshen

(57) ABSTRACT

A modular system for streets formed of a top module, a bottom module, an internal cavity formed within the bottom module, cables positioned within said bottom module, a computing device, sensors operatively associated with said computing device, and communications hardware configured to communicate information from said sensors to a second computing device positioned exterior to said modular system.

17 Claims, 16 Drawing Sheets

(56) References Cited

U.S. PATENT DOCUMENTS

| | | | | |
|---|---|---|---|---|
| 6,945,731 | B1 * | 9/2005 | Vait | G09F 17/00 116/173 |
| 7,566,980 | B2 * | 7/2009 | Fein | F03G 7/04 290/2 |
| 7,629,558 | B2 * | 12/2009 | Petrenko | A63C 3/00 219/492 |
| 7,708,493 | B2 * | 5/2010 | Jung | G09F 9/35 116/63 R |
| 7,857,543 | B2 * | 12/2010 | Troster | E01C 1/002 404/1 |
| 8,172,478 | B2 * | 5/2012 | Sing | E01C 1/002 404/1 |
| 8,214,957 | B2 * | 7/2012 | Miettinen | E01D 18/00 14/77.1 |
| 8,730,063 | B1 * | 5/2014 | Souther | E01F 13/123 404/6 |
| 2005/0286972 | A1 * | 12/2005 | Gongolas | E01F 9/576 404/9 |
| 2008/0150296 | A1 * | 6/2008 | Fein | F03D 9/25 290/1 R |
| 2011/0035140 | A1 * | 2/2011 | Candy | E01F 9/578 701/119 |
| 2011/0148647 | A1 * | 6/2011 | Miller, II | G08B 13/1672 340/686.1 |
| 2011/0302858 | A1 * | 12/2011 | Siewert | E01C 9/00 52/173.3 |
| 2016/0052398 | A1 * | 2/2016 | Richards | B60M 1/34 191/48 |

* cited by examiner

SMART MODULAR STREET AND SIDEWALK

INDEX TO RELATED APPLICATIONS

This application is a non-provisional of and claims benefit to each of U.S. Provisional Patent Application 62/918,043 filed Jan. 15, 2019 and U.S. Provisional Patent Application 62/920,939 filed May 23, 2019 the disclosures of which are incorporated herein by reference in their entirety.

BACKGROUND OF THE INVENTION

Roadways and right of ways occupy significant amounts of land around the world. Except for the utility of transport, most of this land is otherwise unproductive. There have been many speculative hypotheses for improving the usefulness of roadways and sidewalks, but they are often prohibitively complex and expensive.

The present invention addresses this need with a novel system and method for creating functional or "smart" roads and sidewalks.

SUMMARY OF THE INVENTION

The present invention as disclosed herein provides for numerous aspects of improvement. Any one of these alone are contemplated a having improved utility and, in the alternative, any combination of two or more of the novel aspects are contemplated as providing a significant improvement in utilization of roadways, sidewalks, right of ways, or combinations thereof. Street, as used herein, refers to any one or combination of roadways, sidewalks, right of ways.

In one embodiment, the present invention is constructed and arranged with modules contributing to each of ease of assembly, installation, and maintenance. In this configuration there is a top module constructed and arranged to house a network of sensors and cables. The Network of sensors and cables in the present invention are preinstalled in the manufacturing facility where the module is manufactured. Thus, for ease of installation and to reduce cost, the module comes assembled and ready to be installed on the street site.

In one embodiment, the present invention is constructed and arranged with modules that are pre-manufactured in a manufacturing facility. The modules are manufactured per design of the city managers/planners, engineers, other related persons, or combinations thereof. Thus, the modules will have any shape and form with planned cavities to house sensors, computer, cables, and devices. As one non-limiting example, one module is constructed with a heater for a certain section of the street to melt snow and ice. Another non-limiting example provides another module is constructed with sensors and signaling lights embedded on the surface of the street.

In one embodiment, the present invention is constructed and arranged with grooves added to the street on any pattern desired to remove water and avoid slippery roads.

In one embodiment, the present invention is constructed and arranged with top modules remove easily to expose underground utilities and facilitate repair.

In one embodiment, the present invention is constructed and arranged with top modules that are easily replaced to allow the inclusion of new features with the module system. This is a novel feature in that it eliminates the need to break down the street for upgrades and/or repairs. The new module, with new features included on it, is brought to the location where the upgrade is desired. The old module is removed and the new one is installed.

In one embodiment, the present invention is constructed and arranged as a modular system containing a cooling system therein.

In one embodiment, the present invention is constructed and arranged as a modular system configured for installation on top of the existing street/roadway, sidewalk, right of way, or combinations thereof. In this configuration the invention provides an added benefit in that it will increase the height of the road that is helpful in places where there are floods or susceptibility to flooding.

In one embodiment, the present invention is constructed and arranged as a modular system configured with cables inside the modules creating a hard wired system more reliable than wi-fi connection.

In one embodiment, the present invention is constructed and arranged as a modular system configured Wi-fi connection the installation of wi-fi spots embedded in the modules.

In one embodiment, the present invention is constructed and arranged as a modular system configured with a combination or hard wired communications cables and Wi-fi connection the installation of wi-fi spots embedded in the modules.

In one embodiment, the present invention is constructed and arranged as a modular system configured to compile and transmit information related to the roadway.

The information on the tubes and cables that are within the top module and in the underground cavity on the bottom module are registered into a bar code on the surface of the top module. Thus, allowing for the utility companies and contractors to have access to information on the exact utility installed on the location of work where expansion or repair is to be performed.

The idea is to have modular and smart components to build roads including the sidewalks and streets. The modular approach helps avoid the need to breakdown streets and sidewalks when there is a cable issue, leakage and/or any other issues concerning the utilities that go underground, under the street and sidewalks. At the same time the modular approach allows to upgrade utilities like running more fiber cables. Rather than breaking down the street or sidewalk, the top module of the street and/or sidewalk is removed to expose the utilities pipelines and tubes underground. After the utilities issue is resolved or upgraded, the top modular component is placed back.

Additionally, the idea is to have a Smart functionality capable of collecting information from the environment, mainly the Street and Sidewalk surface, plus other information from the Internet. This information would be the input to the computer embedded in the Street and Sidewalk. The computer makes calculations based on programming and/or AI embedded in the computer CPU and gives output to devices, that are mainly housed in the Street and Sidewalk, to perform tasks.

Utilities that are under the street and sidewalk, like power and internet cables, water, sewage, can be utilized as means to provide power and information to the computer. At the same time the computer can send information and tasks for the devices to perform.

For example, the "Smart" top modules can contain heaters embedded in them to melt ice and/or snow. The top modules of the smart street have grooves and present an incline towards the side of the street to allow the melted ice to flow towards the side of the street, leaving the street surface as dry as possible to avoid slippery street and thus accidents.

Additionally, a set of sensors connected to a network capture and send information on passing vehicles to a server. Computer software calculates probability of two successive vehicles being in collision path and send information to the cars' computers to modify their path or to force the vehicles to stop.

In one embodiment, the present invention is a modular system for streets, said system comprising:

a top module;

a bottom module, said bottom module constructed and arranged to connect one to another with successive bottom modules, and each bottom module further constructed to mate with a top module connected on an upper surface of said bottom module;

an internal cavity formed within said bottom module;

cables positioned within said bottom module;

a computing device;

sensors operatively associated with said computing device; and communications hardware configured to communicate information from said sensors to a second computing device positioned exterior to said modular system.

In one embodiment, the present invention constructed with an elevated height in a street center and sloping to a lower height on a street edge.

In one embodiment, the present invention is constructed with a 2% slope from one end of the module to the other end of the module providing a shape and configuration for water and sewage to gravitationally move along the direction of the road. In one embodiment, the slope is from the edge of the street towards the center of the street and there are drains in the center of the street to collect water. In another embodiment, the slope is from the center of the street to the side of the street for water to run off the roadway.

In one embodiment, the present invention provides the top module is constructed and arranged with pipes, cables, or combinations thereof configured to house utility wires, communications wires, or combinations thereof.

In one embodiment, the present invention further comprises one or more exit or perpendicular conduit branch constructed to accommodate cables exiting from said system.

In one embodiment, the present invention top modules are positioned above said exit conduit have indicia disposed thereon, indicating depth, location, diameter, dimensions or combinations thereof of said conduits positioned below said indicia.

In one embodiment, the present invention the indicia is printed, provided as a barcode, provided as a computer readable wireless transmission chip, or combinations thereof.

In one embodiment, the present invention bottom modules have incorporated there with a plurality of clamping guides constructed and arranged to facilitate attachment in succession of successive bottom modules.

In one embodiment, the present invention top modules are formed with one or more cavities constructed and arranged to house cables, sensors, computers, or combinations thereof.

In one embodiment, the present invention top modules are formed with solar panels on upper surface of said top modules.

In one embodiment, the present invention has one or more sub modules positioned with said system, wherein said sub modules are removable and provide access to any of top module cables or bottom module pipes.

In one embodiment, the present invention bottom module is anchored to ground on which said bottom module is placed.

In one embodiment, the present invention top module has a heater embedded in said top module.

In one embodiment, the present invention top module has an upper surface formed with a plurality of grooves for facilitation of water run off.

In one embodiment, the present invention is constructed with a 2% slope from a first end of a completed module to a second end of a completed module providing a shape and configuration for water and sewage to gravitationally move along said slope.

DETAILED DESCRIPTION OF THE PREFERRED EMBODIMENT

The present invention provides a system referred to as a "Smart" Modular Street and Sidewalk is comprised of Modules.

Figure 1:
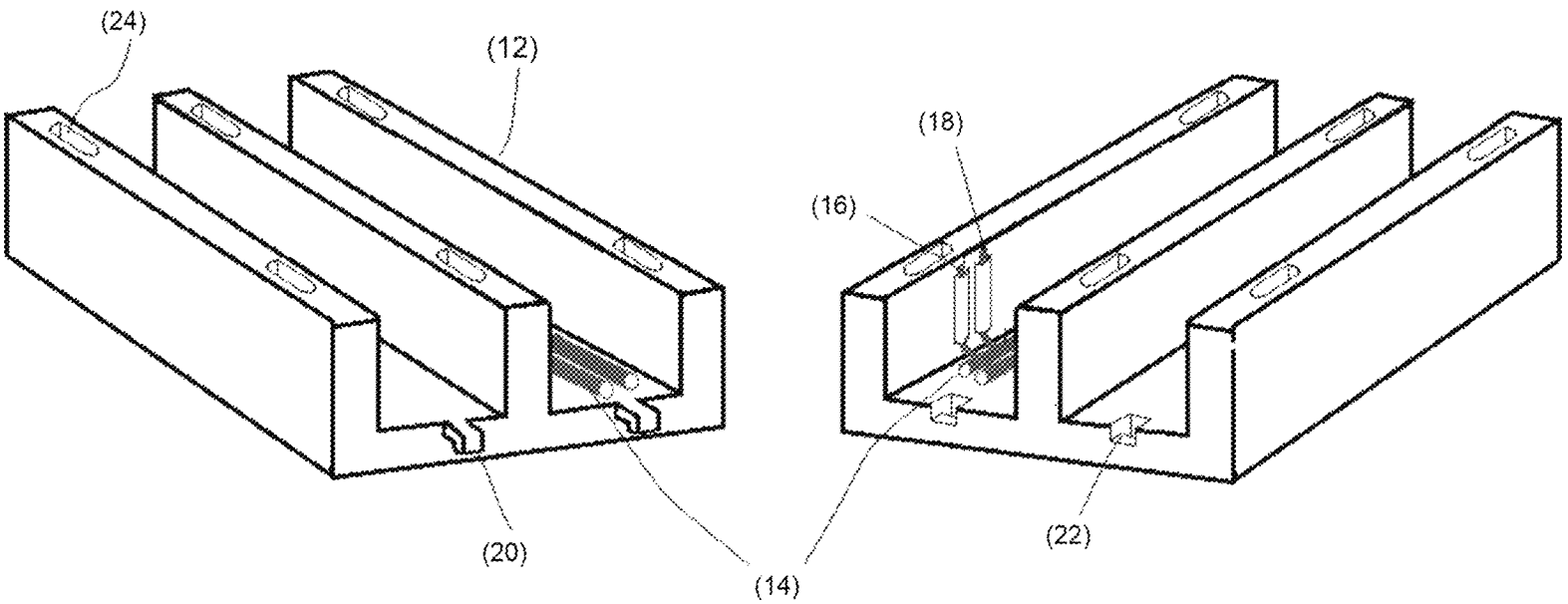
FIG. 1 is a side perspective view of modules according to one embodiment of the present invention.

As shown in FIG. 1, bottom modules 12, have a cavity formed therein to allow utilities pipelines 14, like power, network, water, sewage, or combinations thereof to run there through. Other utilities pipelines or tubes can run within the bottom modules as well.

Figure 11:
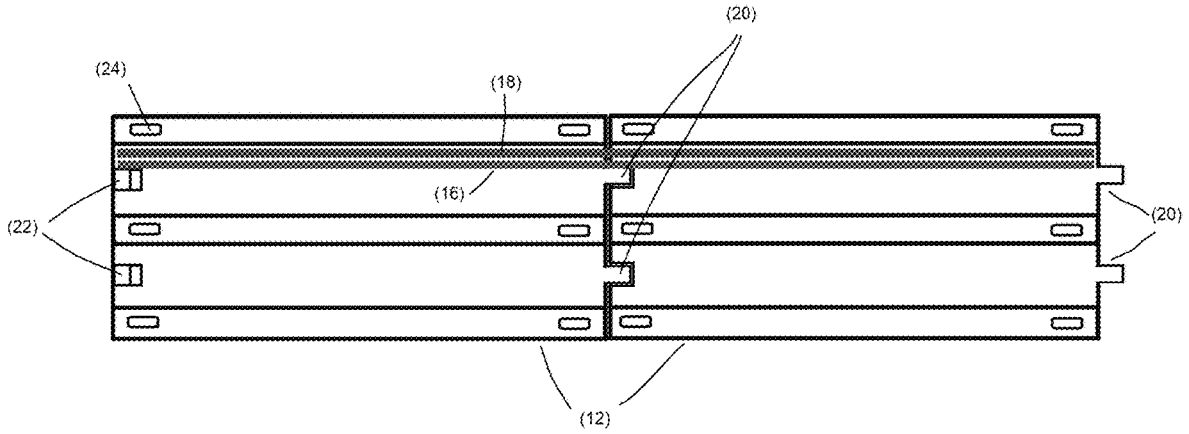
FIG. 11 is view of successive modules connected according to one embodiment of the present invention.

Bottom module 12 contains hooks 20 at one end, a first end, and cavities 22 at the opposite of second end to allow one bottom module 12 to connect with the next one, as shown in FIG. 11.

Figure 15:
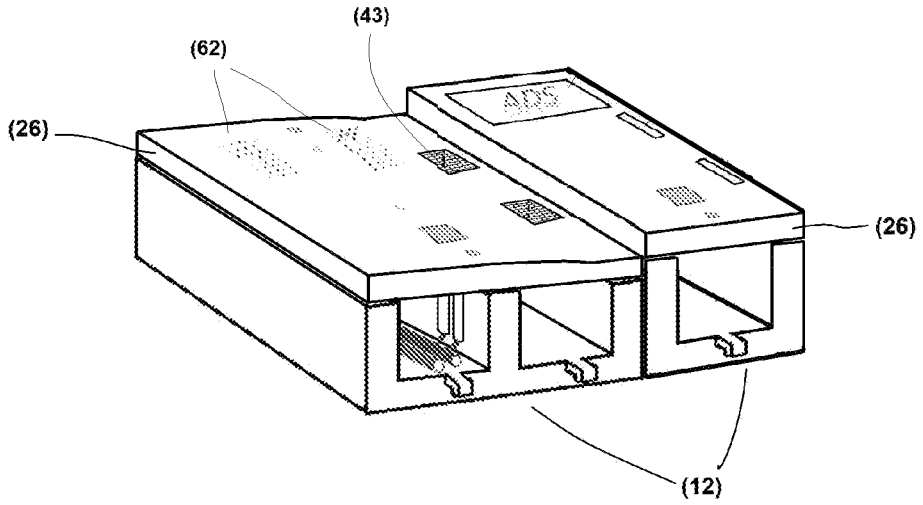
FIG. 15 is a top perspective view of a module according to one embodiment of the present invention.

Power cables 16 and Internet-Network cables 18 branch from the power and network cables that are within pipelines 14 towards the top module 26. In one embodiment, water is pumped up from the utilities underground to the top module 26. Top modules 26 sit on top of the bottom modules 12 (see FIG. 15). Top modules 26, in one embodiment are formed to be the surface of the Street and/or Side Walk. Alternatively, an additional surface module can be added on top of the top module 26.

Figure 2:
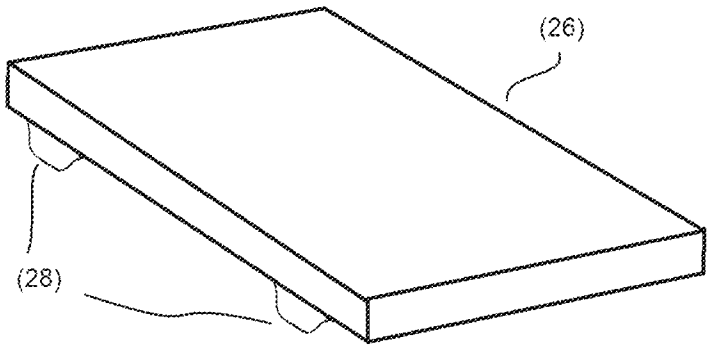
FIG. 2 is a top perspective view of a top module according to one embodiment of the present invention.

Orifices 24 on the bottom module 12 are formed to allow clamping and/or connection of top module 26 by means of protuberances 28 that are formed to mate and connect or fit into the orifices 24, as shown in FIG. 2.

Figure 3:
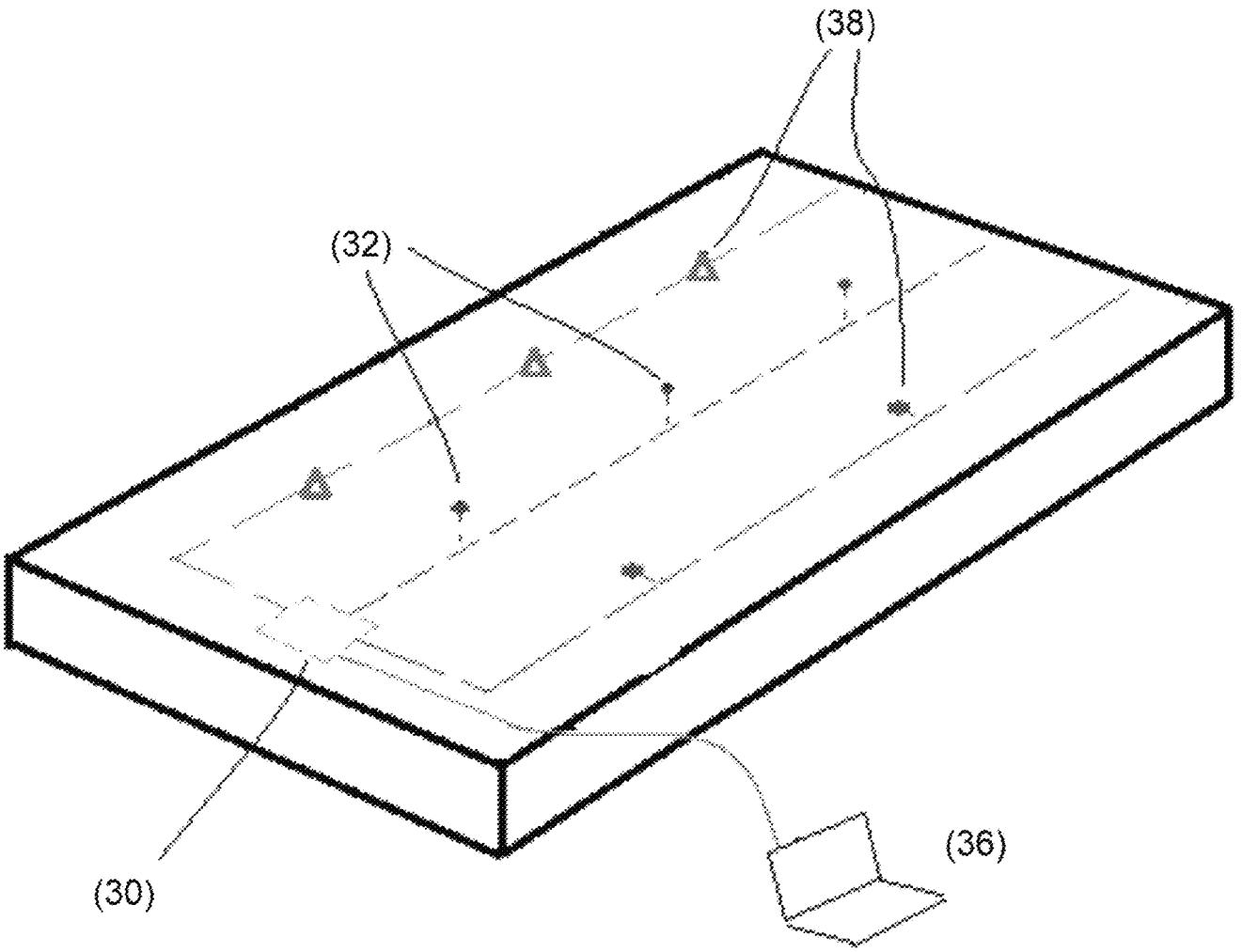
FIG. 3 is a top cross sectional perspective view of a module according to one embodiment of the present invention.
Figure 4:
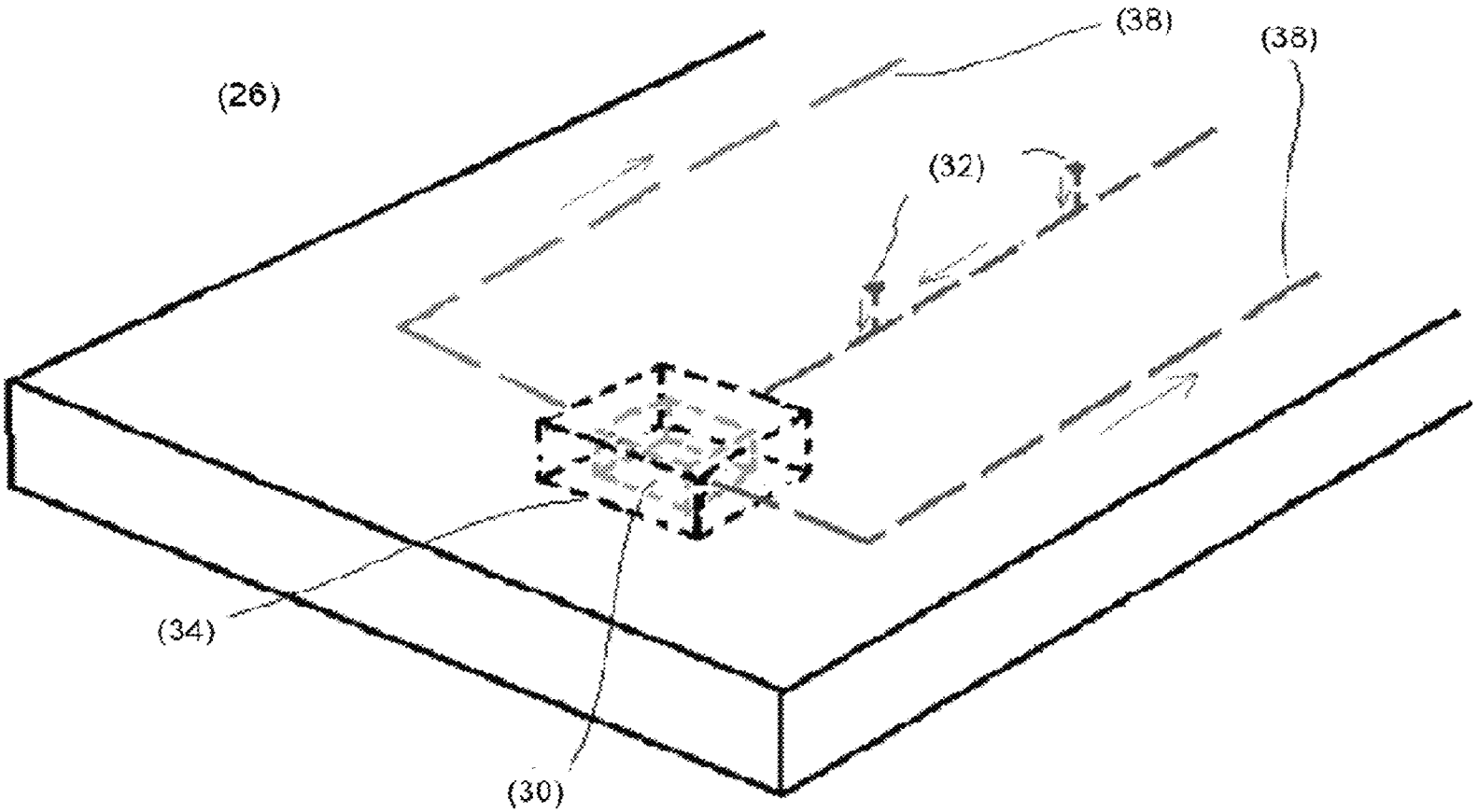
FIG. 4 is a top partial cross sectional perspective view of a module according to one embodiment of the present invention.
Figure 5:
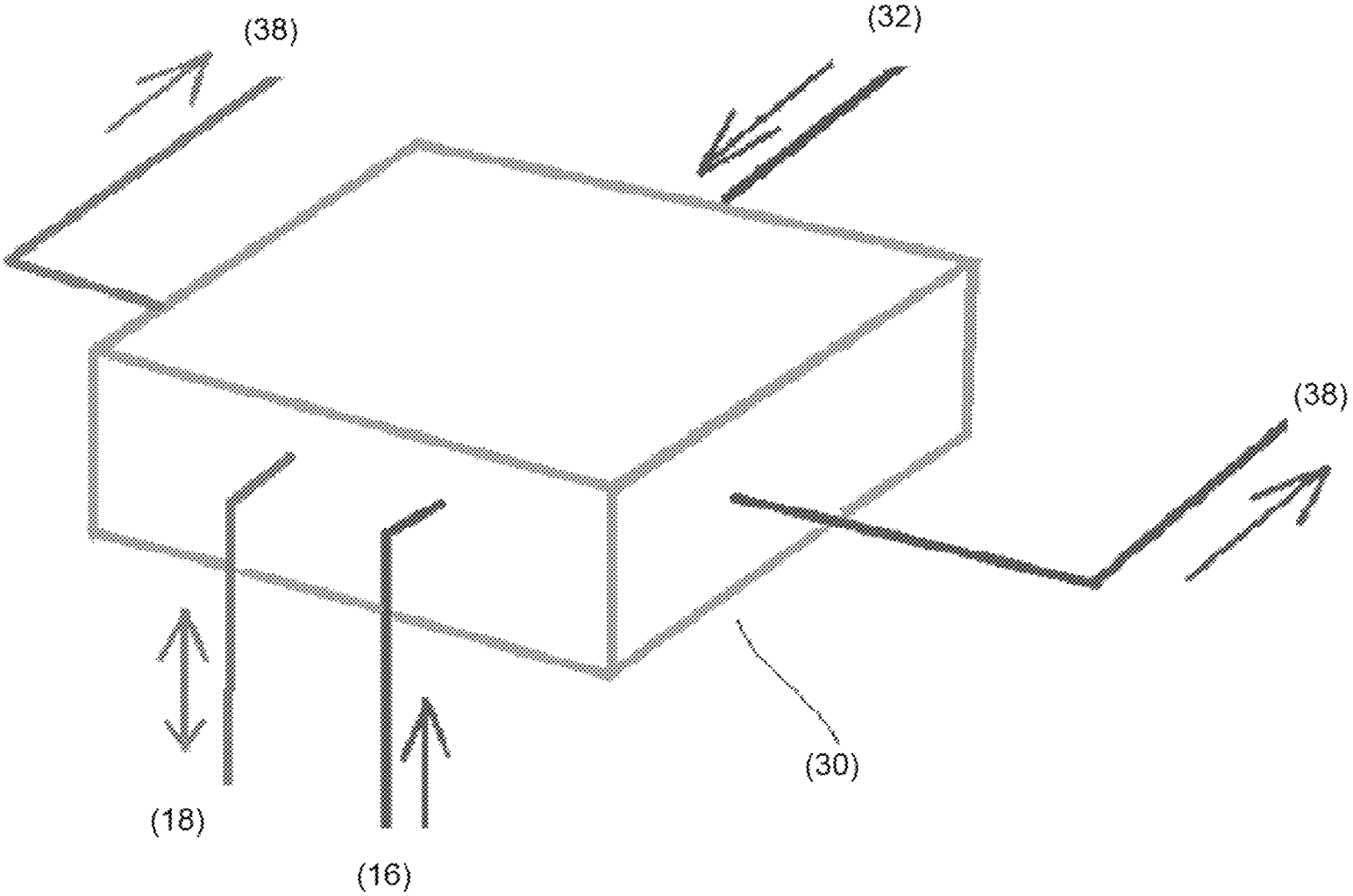
FIG. 5 is a module according to one embodiment of the present invention.
Figure 6:
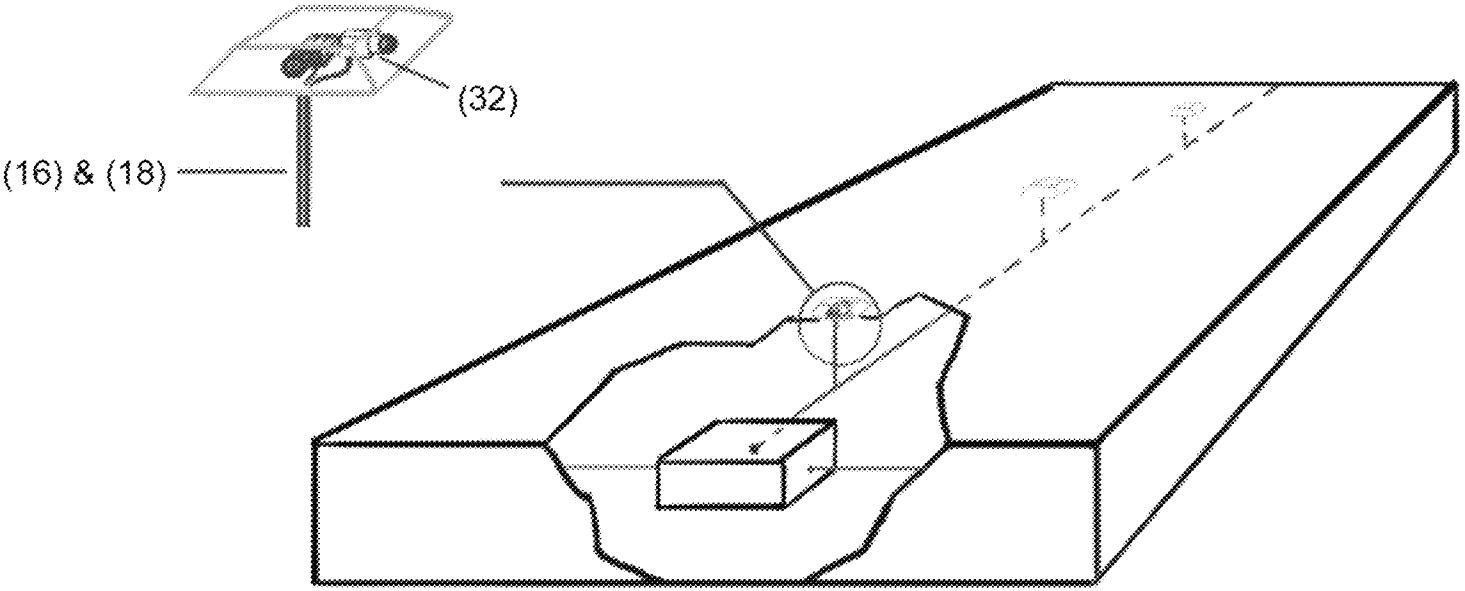
FIG. 6 is a top partial cross sectional perspective view of a module according to one embodiment of the present invention.

Although the figures show placement of sensors 32, the elements in this position, in one embodiment are sensors, cameras, or combinations thereof and are placed within the top module 26, as demonstrated in each of FIGS. 3, 4 and 6. Sensors 32, in one embodiment are sensors configured to detect presence of vehicles or people moving on the surface of the top module 26. Sensors 32, in one embodiment are sensors to detect any of snow or ice, rain and temperature, combinations thereof or system status relating to leakage and/or power failure.

The information captured by the sensors 32 is then transmitted and becomes input to the computer 30, as demonstrated in each of FIGS. 3, 4, 5 and 6. The computer 30 also receives power and information from the utilities that go underground, like power 16 and Internet 18, see FIGS. 1 and 5. In one embodiment, a distribution transformer is utilized to convert the electric utility transmission lines voltage to the required voltage on the lines that feed the devices' installed in the module.

Computer 30 is positioned inside a computer cavity 34, which is inside the top module 26, as in FIGS. 3 and 4. Alternatively, a PLC may be used instead of the Computer, or together with the Computer.

Computer 30, in one embodiment is operatively connected either directly or wirelessly with second computer 36 as seen FIG. 3. Second computer 36, in one embodiment is utilized to program or reprogram the internal CPU in the computer 30 that is inside the top module 26.

Computer 30, in one embodiment receives input from the system sensors, makes the computations per program and sends output 38, through cables and connectors or Wi-Fi, for Devices to perform tasks.

The Devices can be embedded inside or can be outside the top module 26.

Figure 7:
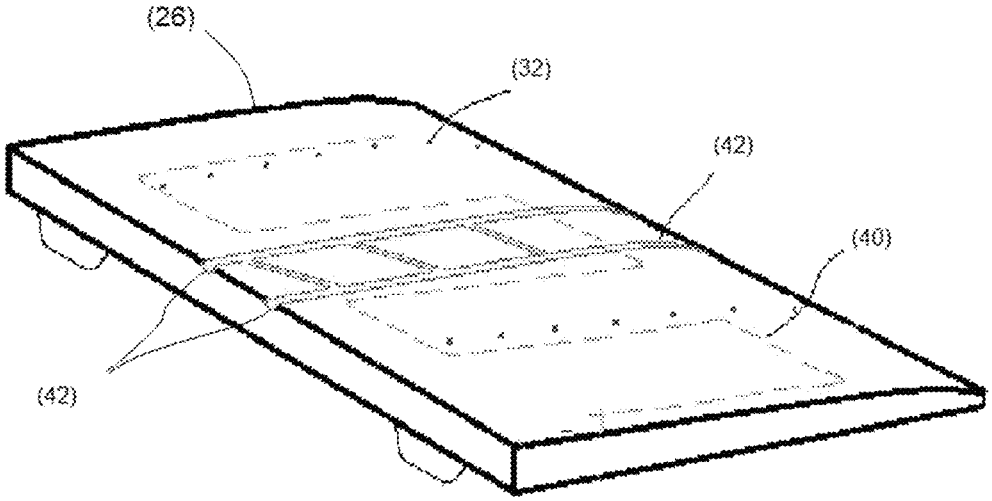
FIG. 7 is a top partial cross sectional perspective view of a top module according to one embodiment of the present invention.
Figure 13:
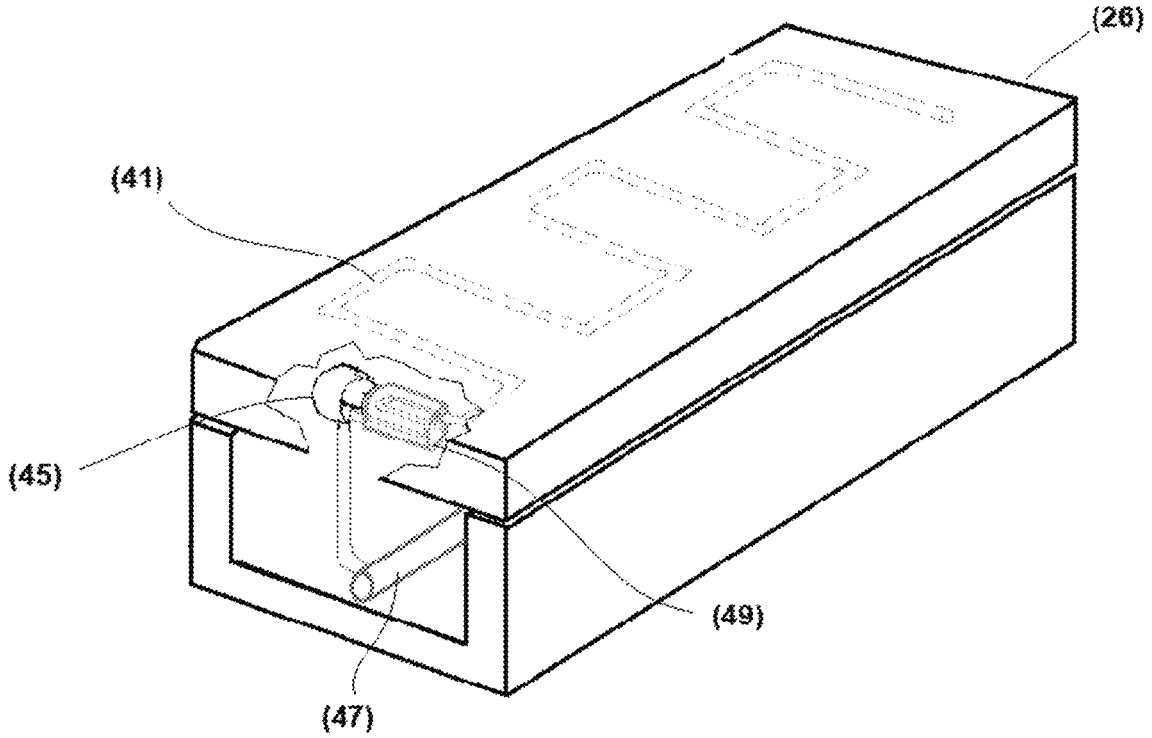
FIG. 13 is a top partial cross sectional perspective view of a module according to one embodiment of the present invention.

Top module 26, in one embodiment, houses heater 40, An another embodiment, top module 26 as a polarity of grooves 42, as in FIG. 7. If the embedded heater 40 is electric, the same is connected to the power cables 16 using a necessary transformer and is constructed to melt ice and/or snow on the top surface of top module 26. The heater, in one embodiment is a pipe 41, embedded in the top module 26, which carries water pumped by a pump 45 from the water utility 47 and heated by a small heater 49 (see FIG. 13). Groves 42 present a pattern to allow water from snow or rain to flow towards the side of the street leaving the sidewalk and street surface as dry as possible to avoid slippery sidewalks and thus accidents.

The Smart Modules, in one embodiment, contain a variety of features or devices. For example, one module can come with a heater 40 for a certain section of the street to melt snow and ice. Other module can come with sensors 32 and signaling lights 62 embedded on the surface of the street to help redirecting traffic (see FIG. 15).

Methodology and Function

1) An excavation is performed to fit the bottom modules 12. The excavation can be 2 to 5 feet deep. The excavation can be the width of the street or a fraction of it for the street module. The width of the excavation can be the total width of the sidewalk or a fraction of it for the sidewalk module.
2) Bottom module 12 is laid down on the excavated ground. Bottom Module 12 height is 2 to 4 feet. The height of the bottom module 12, in one embodiment, is greater on one end than the other to allow for a slope.
3) Pipes and tubes 14 that carry utilities cables, like power and internet, are placed on the inside of the Bottom Module 12 cavities. In one embodiment, other utilities pipes and tubes, like water and sewage, run through the bottom module as well.
4) Power or electric 14 and network 16 cables branch up from the electric utility transmission lines and Internet utility cables that run within the pipes or cavities at points specified by designer of the Smart Street Modular system for that part of the city where the system is placed.
5) Electric cables 14 power the computer 30, sensors 32, heater and screens and any other device installed in the modules.
6) Bottom modules 12 attach one to another by means of hooks in one module to cavities 22 in the consequent module.
7) Top module 26 sits on top of the bottom module 12. The Top Module, in one embodiment, is 6 to 12 inches high. The width and length of the top module is to match the width and length of the Bottom Module where it sits on. Protuberances 28 on the Top Module 26, connect with Orifices 24 on the Bottom Module 12 to keep the Top Module 26 in place.

Top Module 26 fits on top of a street or sidewalk modular system. Top Module 26, in one embodiment contains a Computer embedded inside it. The computer has connectors to allow connections with outside sources like an outside or second computer 36, by Internet and/or Ethernet connection, sensors 32. Computer 30 has also connectors to allow connection to other devices 38. The devices may receive instructions with tasks to do from the main computer. The devices may reside outside the top module 26 or they can be embedded inside it. The devices can be a heater to melt ice or snow, a display-to-display advertisement or information 54, an air conditioner to blow cool air through orifices 56 (see FIG. 14), or other device that produces a task to make the use of the sidewalk or street safer, more informative and more pleasant.

The CPU in the computer or the PLC can be programmed in advance with specific tasks for the devices to perform. The CPU can be reprogrammed to allow the existing devices to perform new tasks or to allow additional devices to perform new tasks. The CPU can also be replaced or upgraded. The computer itself can be replaced or upgraded to allow the use of more devices. Artificial Intelligence can be also used in the computer to allow the streets and sidewalk to learn patterns and recommend actions.

An external computer can be connected to the CPU. A programmer can then access the computer 30 and create or modify programs in the CPU.

Top module 26 contains openings to house the computer 30, sensors 32 and other devices as desired. The Engineers and City Planners decide which devices are to be present in a top module 26 to be installed in a specific street. The Engineers designing the top modules 26 give the information on the required openings to the top module 26 manufacturer. The Manufacturer creates the top module 26 with the needed openings based on the designers' blueprint.

The Shape of the modules can vary from one to the other to accommodate devices and functionalities the street designer desires the road to have. They can be also curved to allow corners or turns.

The material for the top modules 26 and bottom modules 12 for both the Smart Street and Sidewalk can be Recycled Plastic and Polypropylene. The manufacturing, in one embodiment, is made by molding or additive manufacturing. Metal or other material can be used to reinforce the structure if needed. The modules are of a fire resistant material. Alternatively, the bottom module is made of concrete or other material.

Figure 8:
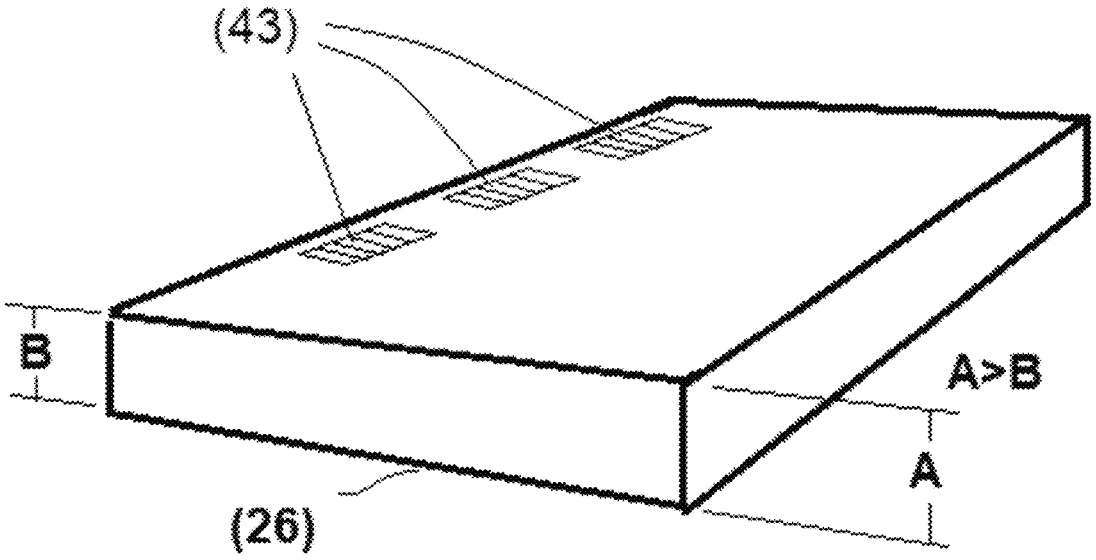
FIG. 8 is a module according to one embodiment of the present invention.

Top module 26, in one embodiment, is taller on the side that is towards the middle of the street (B) and shorter on the side that is towards the side walk (A) (see FIG. 8). The difference in the elevations allows for the water from rain or snow to flow from the middle of the street to the sides. Alternatively, the top module 26 is taller on the side that is towards the side walk and smaller on the side that is towards the middle of the street (A>B in FIG. 8) allowing the water from the rain or the snow to flow towards the middle of the street and falling down through the drains 43 into the cavity of the bottom module 12 that is away from the side walk and towards the middle of the street.

The height of the bottom module 12, in one embodiment, will vary to accommodate for a 2% or similar slope necessary for the water from rain or snow and sewage to move by gravity along the direction of the road. The water can then eventually be removed towards the side of the street into a tank or cisterna.

Figure 9:
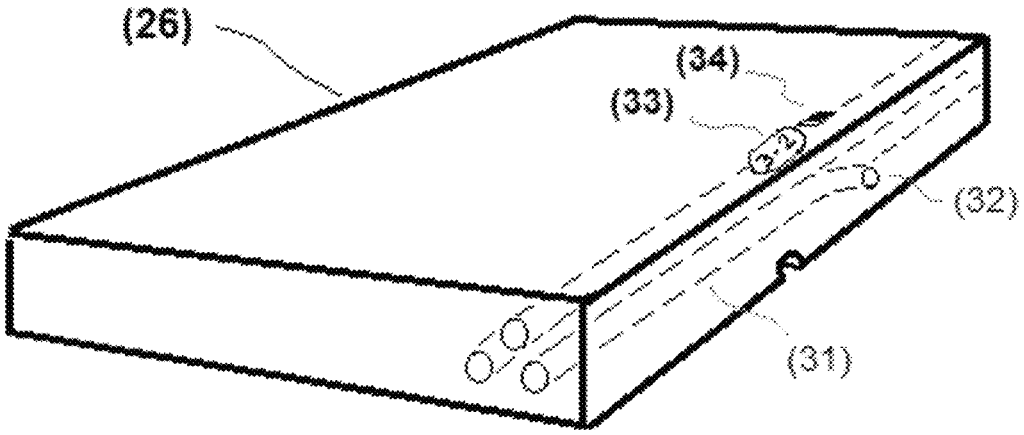
FIG. 9 is a top partial cross sectional perspective view of a module according to one embodiment of the present invention.

Top module 26, in one embodiment, contains internal pipes (see on (31) FIG. 9) to allow the transportation of utilities like fiber optics. Cities sometime require adding more fiber optic. That is usually done by breaking the streets or sidewalk. With the embedded pipes on the modules, there is no need to break down the streets or sidewalks.

Figure 10:
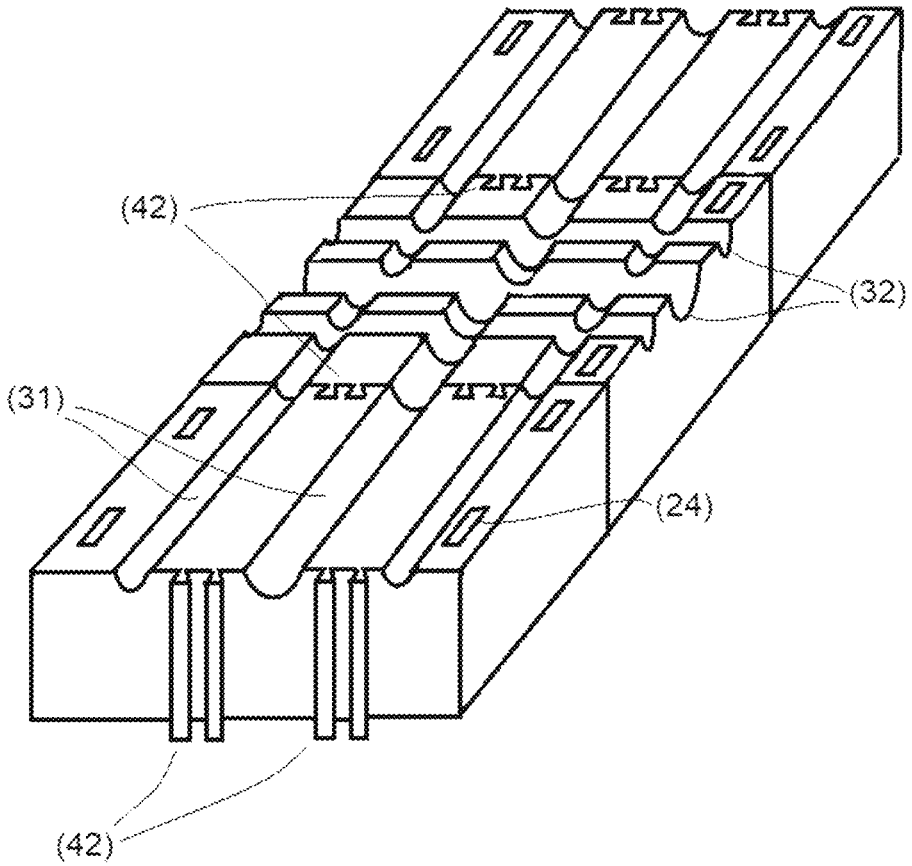
FIG. 10 is view of a module according to one embodiment of the present invention.

In one embodiment, pipes and/or cavities 31 in FIGS. 9 and 10 have a perpendicular branch conduit 32 at a desired location to allow cables and/or pipes to exit from the road towards the residential or commercial buildings.

Conduit 32 exits toward buildings and can be indicated on the top of the top module 26. The indicia 33 contain information on the depth and diameter of the pipe that exits (for example 3-2 in FIG. 9). The 3 is for the depth of the location of the pipeline in inches and the 2 is for the diameter of the pipe in inches. The indicia 33 in one embodiment, is in the form of a barcode 34. The barcode contains information on all the dimensions of the Module including providing inventories, maps, or locations of communications facilities including wireless facilities or electric utility distribution network.

In one embodiment, modules are connected with each other by using Clamping Guides 42 as shown in FIG. 10.

In one embodiment, the manufacturing of the modules are in the form of additive manufacturing (3D printing). Alternatively, they can be manufactured by molding or other manufacturing technique.

In one embodiment, the bottom and top modules are be reinforced with metal or other material if considered necessary.

In one embodiment, the modular street system of the present invention is constructed to be placed on top of the existing street to elevate the street and allowing to combat floods.

In one embodiment, the top module 26 contains cavities to house a computer and cables. Alternatively, boxes and tubes are attached to the bottom of the top module 26 to house the computer and run cables.

Figure 14:
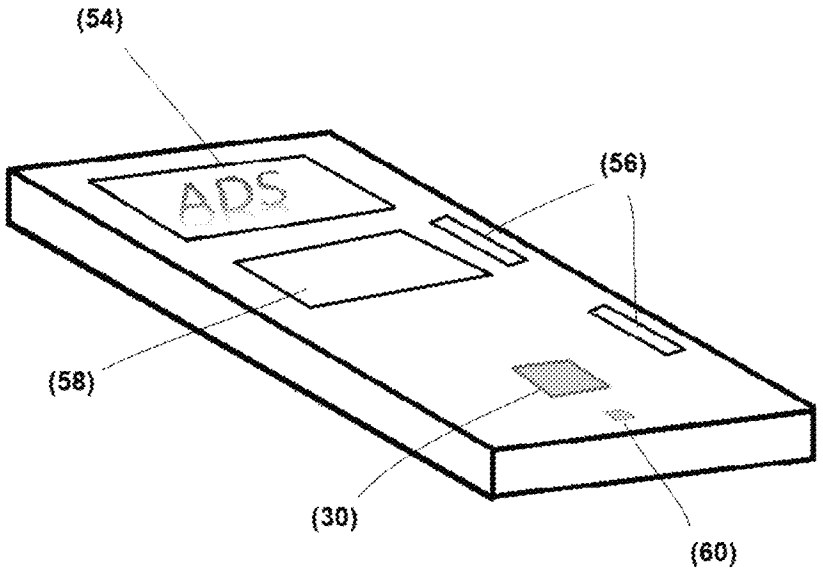
FIG. 14 is a top partial cross sectional perspective view of a module according to one embodiment of the present invention.

In one embodiment, solar panels 58 are placed on the top of the top module 26 to collect solar energy (see FIG. 14).

Figure 12:
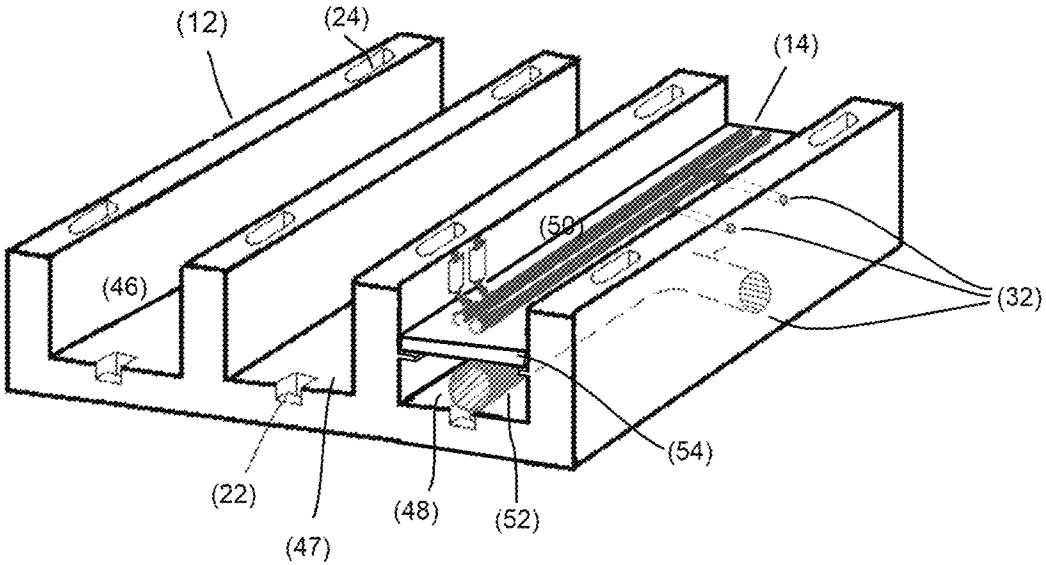
FIG. 12 is a top perspective view of a bottom module according to one embodiment of the present invention.

In one embodiment, bottom module 12 contains one orifice or several orifices on the wall on the side that is towards the sidewalk (see FIG. 12). The orifices 32 are to allow pipes to come out from the main cavity toward the buildings.

Figure 16:
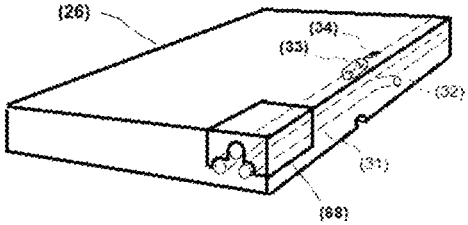
FIG. 16 is a top perspective view partial cross section view of a module according to one embodiment of the present invention.

In one embodiment, the system further comprises a system of submodules 68 formed as a part of the Smart Modular System (see FIG. 16). These submodules are removable as needed from the top module for example to expose cables that go on pipes 31 and 32 in FIG. 9. The bottom modules contain smaller modules constructed to allow pipes to flow through them and. The smaller modules allow for an easier removal of top components to expose utilities in case there is a need to fix or upgrade the utilities.

In one embodiment, the bottom module 12 is anchored to the ground. The top module 26, in one embodiment is anchored to the bottom module 12. In one embodiment, bottom module 12 is clamped to the surrounding excavation.

In one embodiment, the modules contain a middle set of bottom and top modules (see FIG. 10). Those middle modules have cavities running on a perpendicular direction 32 to the direction of the road. These perpendicular cavities are to connect the utilities to the buildings on the side of the road.

As used herein, Utility refers to electric transmission, voice, telegraph, data, or other communications service lines or wireless facilities; railways; sewers; water, heat, or gas mains; pipelines; fences; gasoline tanks and pump; or other structure referred as utility.

In one embodiment, bottom module 12 has several cavities to be used for different purposes (see FIG. 12). Cavity 46 is used to remove water from rain. Cavity 48 is also contemplated as being used to remove water from rain or for sewer or water pipes. Cavity 50 is used for cables. The Sewer 52, water and cables are run towards building by transversal cavities 32. Pipe 52 in one embodiment is a sewer pipe or alternatively a water supply pipe 52 positioned on the middle cavity 47. In one embodiment, cables 14 that are installed on one module can be disconnected from cables on another module. Also, the cables can be disconnected from the cables that go up towards the top module 16 and 18. The surface where the cables lay down, 54 are detachable from the bottom module 12 carrying the cables or utility transmission lines 14 with it. By removing 54 one can expose cavity 48 for repair or upgrade of pipe 52.

In one embodiment, drains 43 on the top module 26 in FIG. 8 collect water from the rain and send it under to the bottom module 12. The bottom module 12 receives the water into the cavity selected to collect the water, i.e.: 46.

Hooks 60 on FIG. 14 are used to pick up the top modules. Alternatively, the top modules can be picked up with a suction machine.

The network or communication facility resulting from the electric and internet cables or fiber optics 14 installed in the Bottom and/or Top modules 12 and 26 together with the computer 30 can be used as a platform of communication services for other ideas from other inventors. The sensors pertaining the other ideas can be added to the platform (ie: the Top or Bottom Modules) to collect information. Those sensors can be connected to the network embedded in the Smart Modular Street platform. At the same time devices from other inventors can be installed in the Smart Modular Street platform to perform tasks that result from the combination of the collection of information from the sensors and the computations from the computer (30) embedded in the Top Module (26). Thus the Smart Modular Street idea can be also used to house other inventions pertaining streets and vehicles and pedestrians that use it.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A modular system for streets, said system comprising:

a top module, said top module configured removable from said system;

a bottom module of unitary construction and having a height of two feet to four feet, comprising a base portion and at least three vertical walls, said bottom module constructed and arranged to connect one to another with successive bottom modules, and an upper surface of said at least three vertical walls of said bottom module configured with a plurality of orifices to mate by direct clamping with a plurality of protuberances formed on an underside of said top module wherein when said top module and said bottom module are mated, a plurality of internal cavities are formed between said base portion of said bottom module and said underside of said top module, each one of said internal cavities between a pair of said at least three vertical walls;

cables positioned within at least one of said internal cavities;

at least one of a sewer or water pipe positioned within at least one of said internal cavities;

a computing device;

sensors operatively associated with said computing device, said sensors comprising at least visual sensors embedded on the surface of the street; and communications hardware configured to communicate information from said sensors to a second computing device positioned exterior to said modular system.

2. The modular system of claim 1 constructed with an elevated height in a street center and sloping to a lower height on a street edge.

3. The modular system of claim 1 constructed with a 2% slope from a first end of a completed module to a second end of a completed module providing a shape and configuration for water and sewage to gravitationally move along said slope.

4. The modular system of claim 1 wherein said top module is constructed and arranged with pipes, cables, or combinations thereof configured to house utility wires, communications wires, or combinations thereof.

5. The modular system of claim 1 further comprising one or more exit or perpendicular conduit branch constructed to accommodate cables exiting from said system.

6. The modular system of claim 5 wherein top modules positioned above said exit conduit have indicia disposed thereon, indicating depth, location, diameter, dimensions or combinations thereof of said conduits positioned below said indicia.

7. The modular system of claim 6 wherein said indicia is printed, provided as a barcode, provided as a computer readable wireless transmission chip, or combinations thereof.

8. The modular system of claim 1 wherein said bottom modules have incorporated there with a plurality of clamping guides constructed and arranged to facilitate attachment in succession of successive bottom modules.

9. The modular system of claim 1 wherein said top modules are formed with one or more cavities constructed and arranged to house cables, sensors, computers, or combinations thereof.

10. The modular system of claim 1 wherein said top modules are formed with solar panels on upper surface of said top modules.

11. The system of claim 1 further comprising one or more sub modules positioned with said system, wherein said sub modules are removable and provide access to either said top module or said bottom module pipes.

12. The system of claim 1 wherein said bottom module is anchored to ground on which said bottom module is placed.

13. The system of claim 1 wherein said top module has a heater embedded in said top module.

14. The system of claim 1 wherein said top module has an upper surface formed with a plurality of grooves for facilitation of water run off, said plurality of groove comprising grooves arranged in a direction from a street center to a street edge.

15. The system of claim 1 further comprising one or more sub modules positioned with said system, wherein said sub modules further include top module pipes having top module cables.

16. The system of claim 15 further comprising one or more sub modules positioned with said system, wherein said sub modules are removable and provide access to any of top module cables or bottom module pipes.

17. The system of claim 1, wherein said bottom module is arranged at least substantially underground.

* * * * *